US010105708B1

(12) United States Patent
Sternick

(10) Patent No.: US 10,105,708 B1
(45) Date of Patent: Oct. 23, 2018

(54) ASPIRATION ADAPTER AND SYSTEM

(71) Applicant: John L. Sternick, Brandon, SD (US)

(72) Inventor: John L. Sternick, Brandon, SD (US)

( * ) Notice: Subject to any disclaimer, the term of this patent is extended or adjusted under 35 U.S.C. 154(b) by 250 days.

(21) Appl. No.: 14/699,049

(22) Filed: Apr. 29, 2015

(51) Int. Cl.
*B01L 3/00* (2006.01)

(52) U.S. Cl.
CPC ..... *B01L 3/563* (2013.01); *B01L 2200/06* (2013.01); *B01L 2300/042* (2013.01)

(58) Field of Classification Search
CPC ..... B01L 3/0213; B01L 3/56; B01L 3/563; B01L 3/567; B01L 3/50825; B01L 2200/06; B01L 2300/042
See application file for complete search history.

(56) References Cited

U.S. PATENT DOCUMENTS 3,244,009 A * 4/1966 Schwarz, Jr. ..... A61M 1/00 222/309
3,945,254 A * 3/1976 Rebold ..... B01L 3/0279 422/932
3,982,899 A 9/1976 Kelm
4,053,284 A 10/1977 Posch
4,228,795 A 10/1980 Babington
4,340,336 A 7/1982 Clary
5,084,241 A 1/1992 Parker
5,171,537 A 12/1992 Wainwright
5,248,056 A 9/1993 Shaw
5,273,717 A 12/1993 Marvin
5,576,214 A 11/1996 Shaw
6,835,353 B2 * 12/2004 Smith ..... B01L 3/5021 210/416.1
7,987,736 B2 8/2011 Rapaud
8,580,574 B2 11/2013 Smith
2010/0140182 A1 * 6/2010 Chapman ..... A61M 1/029 210/741
2013/0259951 A1 * 10/2013 O'Connell, Jr. ..... G01N 33/491 424/529

* cited by examiner

*Primary Examiner* — Brian R Gordon
(74) *Attorney, Agent, or Firm* — Jeffrey A. Proehl; Woods, Fuller, Shultz & Smith, P.C.

(57) ABSTRACT

An aspirator adapter may comprise a cap portion configured to removably mount on a collection container, a pipette interface portion mounted on the cap portion and configured to mount a pipette to the cap portion, and a gun interface portion mounted on the cap portion and configured to interface with a pipette gun. The pipette interface portion may define a pipette interface passage extending through the cap portion and the gun interface portion defining a gun interface passage extending through the cap portion.

11 Claims, 13 Drawing Sheets

ASPIRATION ADAPTER AND SYSTEM

BACKGROUND

Field

The present disclosure relates to pipette apparatus and more particularly pertains to a new aspiration adapter and system for facilitating the transfer of media between containers.

SUMMARY

In one aspect, the disclosure relates to an aspirator adapter for distributing media from a collection container through a pipette. The adapter may comprise a cap portion configured to removably mount on the collection container with a recess for receiving a portion of the collection container, with the cap portion having an inner side for orienting toward an interior of the collection container when the cap portion is mounted on the collection container and an outer side for orienting away from the interior of the collection container. The adapter may also comprise a pipette interface portion mounted on the cap portion and configured to mount a pipette to the cap portion, with the pipette interface portion defining a pipette interface passage extending through the cap portion. The pipette interface portion may include an inner section of the pipette interface portion being located on the inner side of the cap portion and having a section of the pipette interface passage, an outer section of the pipette interface portion may be located on the outer side of the cap portion and having a section of the pipette interface passage, with the pipette interface portion having an outer opening for receiving a portion of the pipette. The adapter may further comprise a gun interface portion mounted on the cap portion and configured to interface with a pipette gun, with the gun interface portion defining a gun interface passage extending through the cap portion. The gun interface portion including an inner section of the gun interface portion being located on the inner side of the cap portion and having a section of the gun interface passage, an outer section of the gun interface portion being located on the outer side of the cap portion and having a section of the gun interface passage, with the gun interface portion having an outer opening for insertion into a barrel of the pipette gun.

In another aspect, the disclosure relates to an aspirator adapter for distributing media from a collection container through a pipette. The adapter may comprise a pipette interface portion configured to mount a pipette to the cap portion and defining a pipette interface passage. The pipette interface portion may include an inner section of the pipette interface portion having a section of the pipette interface passage, and an outer section of the pipette interface portion having a section of the pipette interface passage, with the pipette interface portion having an outer opening for receiving a portion of the pipette. The adapter may also comprise a gun interface portion configured to interface with a pipette gun and defining a gun interface passage. The gun interface portion may include an inner section of the gun interface portion having a section of the gun interface passage, and an outer section of the gun interface portion having a section of the gun interface passage with the gun interface portion having an outer opening for insertion into a barrel of the pipette gun. The adapter may further comprise a connector portion connecting the pipette interface portion and the gun interface portion.

In still another aspect, the disclosure relates to an aspiration system for delivery (aspiration) of media between containers. The system may comprise a collection container having an upper end with an opening into an interior of the container, and a pipette having a proximal end with a proximal opening, a distal end with a distal opening, and a substantially hollow interior extending from the proximal opening to the distal opening. The system may also include a pipette gun configured to apply positive pressure and negative pressure through a barrel, and an aspirator adapter. The aspirator adapter may also comprise a cap portion removably mounted on the collection container with a recess receiving a portion of the collection container, with the cap portion having an inner side for orienting toward the interior of the collection container and an outer side oriented away from the interior of the collection container. The adapter may also include a pipette interface portion mounted on the cap portion and removably mounting the pipette to the cap portion, with the pipette interface portion defining a pipette interface passage extending through the cap portion. The pipette interface portion may include an inner section of the pipette interface portion being located on the inner side of the cap portion and having a section of the pipette interface passage, and an outer section of the pipette interface portion being located on the outer side of the cap portion and having a section of the pipette interface passage, the pipette interface portion having an outer opening receiving a portion of the pipette. The system may also comprise a gun interface portion mounted on the cap portion and removably mounted on the pipette gun. The gun interface portion may define a gun interface passage extending through the cap portion, and may include an inner section of the gun interface portion being located on the inner side of the cap portion and having a section of the gun interface passage. An outer section of the gun interface portion may be located on the outer side of the cap portion and having a section of the gun interface passage, the gun interface portion having an outer opening inserting into the barrel of the pipette gun.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
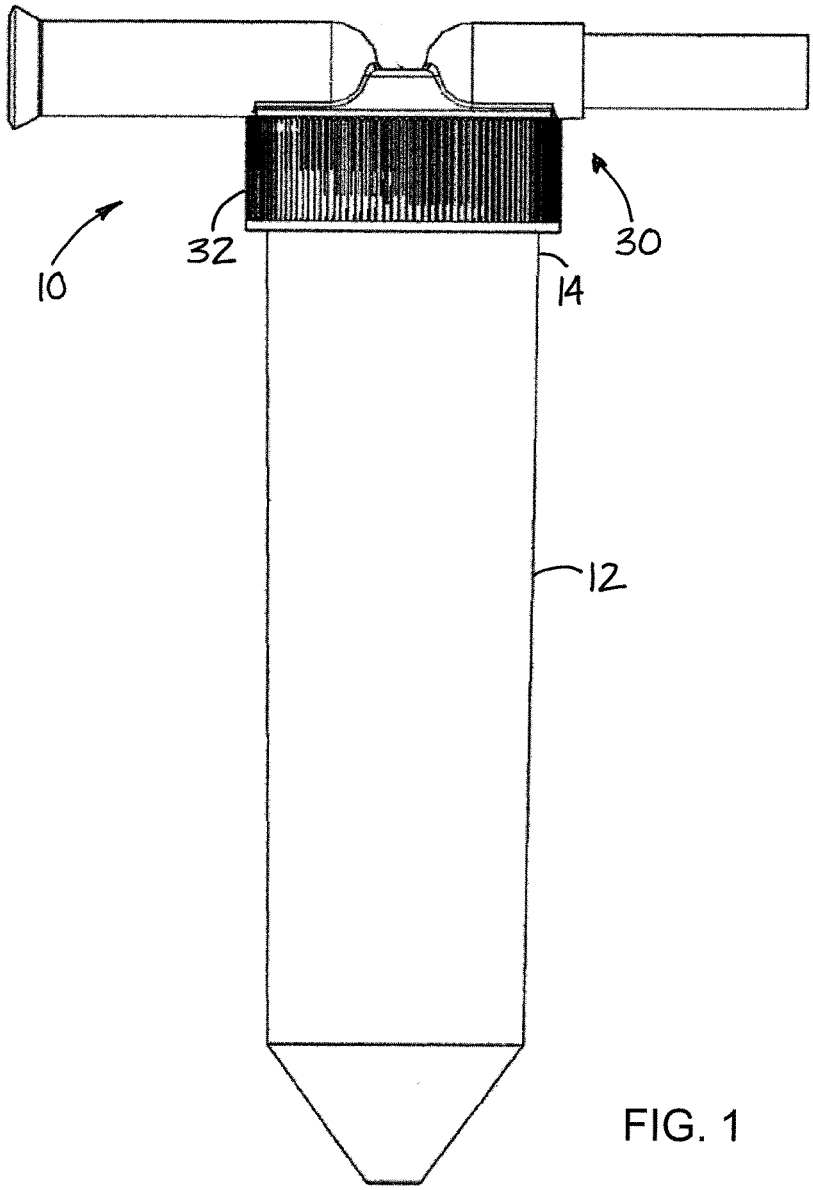
FIG. 1 is a schematic side view of elements of a new aspiration system with an aspiration adapter according to an embodiment of the present disclosure.
Figure 2:
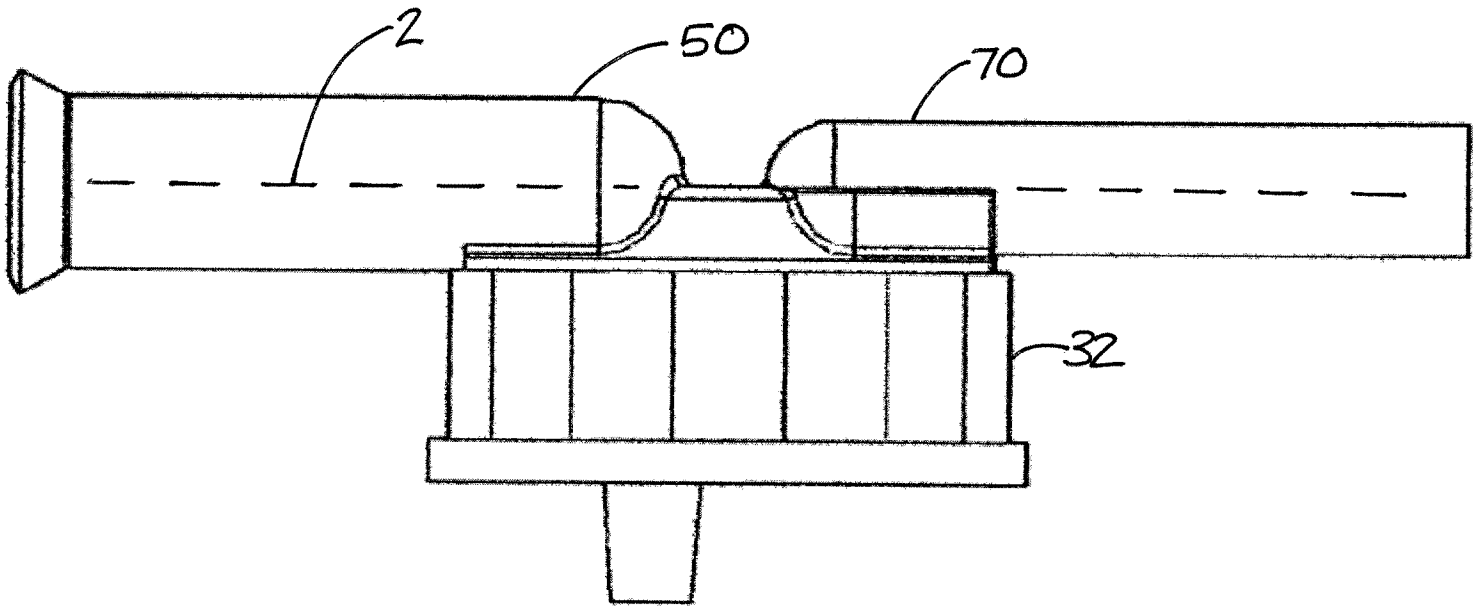
FIG. 2 is a schematic side view of an aspiration adapter according to an embodiment of the present disclosure.
Figure 3:
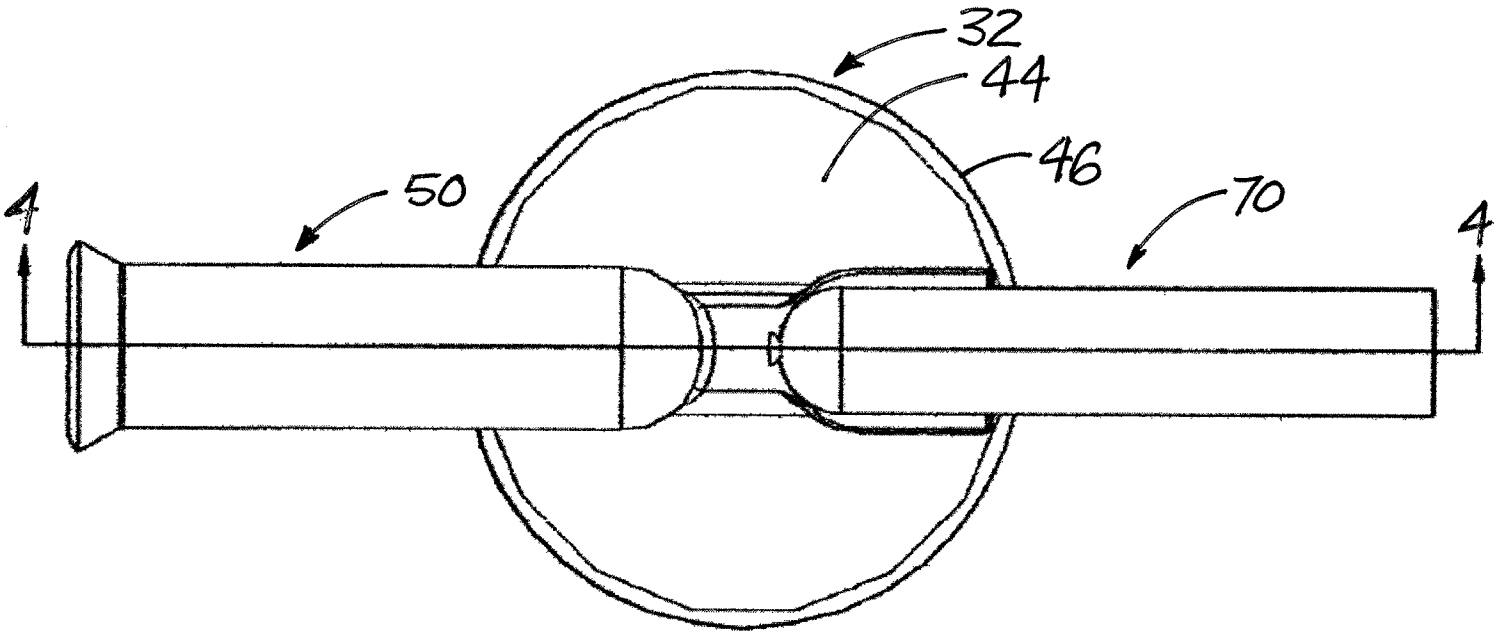
FIG. 3 is a schematic top view of the adapter, according to an illustrative embodiment.
Figure 4:
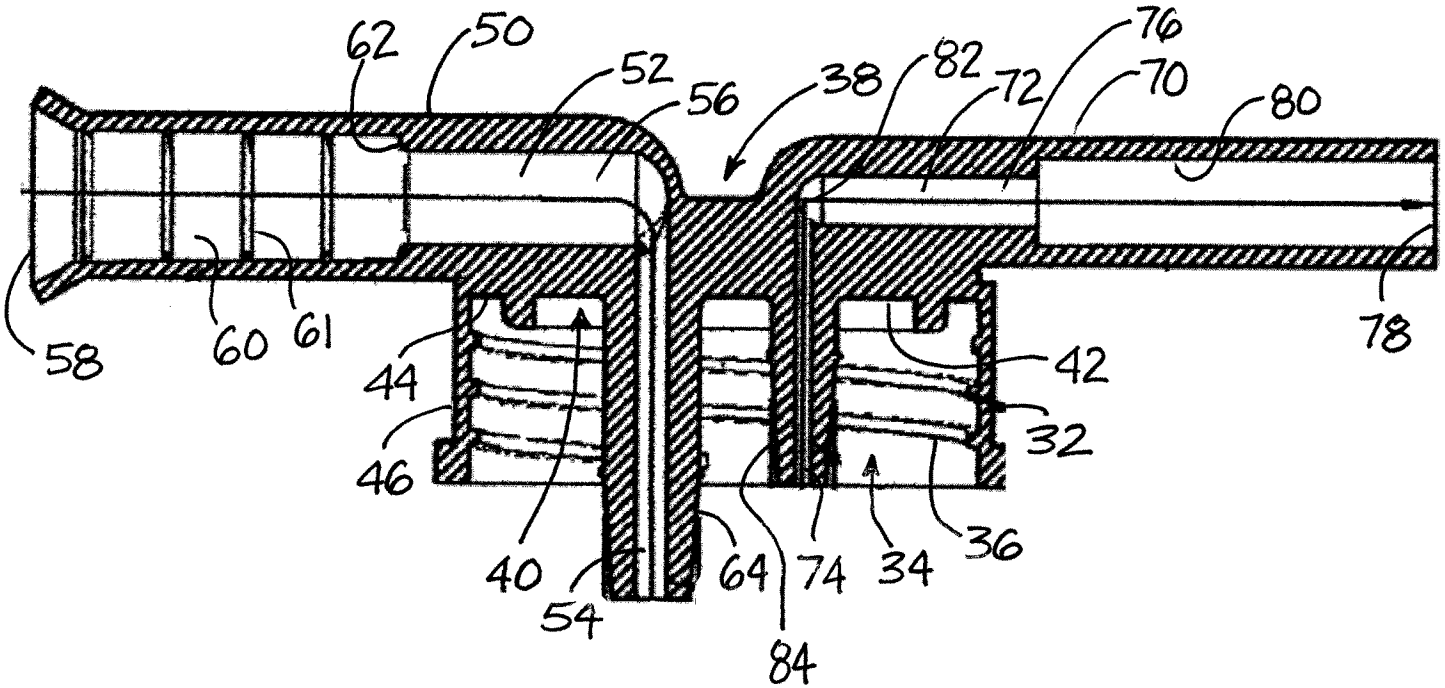
FIG. 4 is a schematic sectional view of the adapter taken along line 4-4 of FIG. 3.

With reference now to the drawings, and in particular to FIGS. 1 through 19 thereof, a new aspiration adapter and system embodying the principles and concepts of the disclosed subject matter will be described.

Distributing a sample from one container to a number of different containers is a common practice in a laboratory setting. Often a portion of the sample in a first container is drawn into a pipette and then moved to a second container where the portion of the sample is emptied onto the second container, and this process may be repeated for a third, fourth, fifth, etc. container. Repeated movement of the pipette into and out of the sample in the first container, and to the other containers may introduce contaminants into the sample in the first container as well as the other containers. Applicant has recognized that effectively increasing the capacity of the pipette without enlarging the pipette itself may reduce the need to repeatedly move the pipette between containers and the contaminations that may result. The applicant has also recognized that the utilization of conventional laboratory elements in such a system increases the economy and usability of such a system. Embodiments of the disclosed system may provide such advantages as well as other benefits to the user.

In one aspect, the disclosure relates to an aspiration system 10 for aspiration or delivery of media between containers. The media generally is a flowable material, such as a liquid that may be drawn into a tubular pipette under the influence of negative pressure or a vacuum in the pipette. In general, the system 10 may include a collection tube 12 for holding the media, a pipette 20 for holding and transferring media between the containers, a pipette gun 28 for applying positive or negative pressure to the interior of the pipette 20, and an aspirator adapter 30 which facilitates rapid movement of media into and out of the pipette 20 and the collection tube.

In greater detail, the collection tube 12 may have an upper end 14 with an opening, and the opening may be defined by a rim 16. The collection tube 12 may have an interior suitable for receiving and holding media to be dispensing therefrom. External threads may be formed on a portion of the exterior surface of the collection tube 12 located adjacent to the rim. Conventionally-available tubes with these characteristics may be suitably used as the collection tube. The pipette 20 may have a substantially hollow interior and a proximal end 24 with a proximal opening and a distal end 26 with a distal opening, with the hollow interior extending between the proximal opening at the end 24 and the distal opening at the end 26. Conventionally-available pipettes with these characteristics may be suitably used as the collection tube. The pipette gun 28 may be configured to apply various types of pressure to the adapter 30, including negative pressure and positive pressure.

While in some aspects of the disclosure the aspirator adapter 30 may be a part of the aspiration system 10, in other aspects of the disclosure the adapter 30 may be utilized independent of other system elements. In general, the aspirator adapter 30 may include a cap portion 32, a pipette interface portion 50 and a gun interface portion 70 (see, for example, FIG. 19).

The cap portion 32 may be configured to mount on a collection tube, such as collection tube 12. The cap portion 32 may have a recess 34 for receiving a portion of the collection tube, such as the upper end 14 and rim 16 of the collection tube. A surface on the cap portion that defines the recess 34 may have internal threads 36 formed thereon for engaging the external threads 18 on the collection tube 12, although other structures may be utilized for forming a connection between the cap portion and a collection tube or other container. The cap portion 32 may have an outer side 38 and an inner side 40, with the inner side 40 generally facing an interior formed by mating of the cap portion the collection tube. The outer side 38 of the cap portion may be located opposite of the inner side, and being generally directed opposite to and away from the interior of the collection tube. The inner side 40 may have an interior surface 42, with the outer side 38 being located substantially opposite of the interior surface.

In some embodiments, the cap portion 32 may include a lid section 44 and a lip section 46 with the lip section generally extending from the interior surface 42 of the lid section and having the internal threads 36 formed thereon in embodiments employing a threaded connection. In some embodiments, a soft mat material (see, e.g., FIG. 13) may be positioned adjacent to the interior surface 40 of the cap portion on the lid section. In embodiments, a sealing member 47 (see, e.g., FIG. 14) such as an O-ring may be positioned adjacent to the inner surface of the lip section 46 of the cap portion for facilitating the formation of the seal between the cap portion and the collection tube or other container. A frusta-conical structure 49 (see, e.g., FIG. 15) may be positioned on the inner side of the cap portion, and a flexible cone flap 45 (see, e.g., FIG. 16) may be employed to seal the cap portion into the container. Some or all of these structures may be used with or without threading to form a connection or seal between the cap portion and the tube or container.

Figure 5:
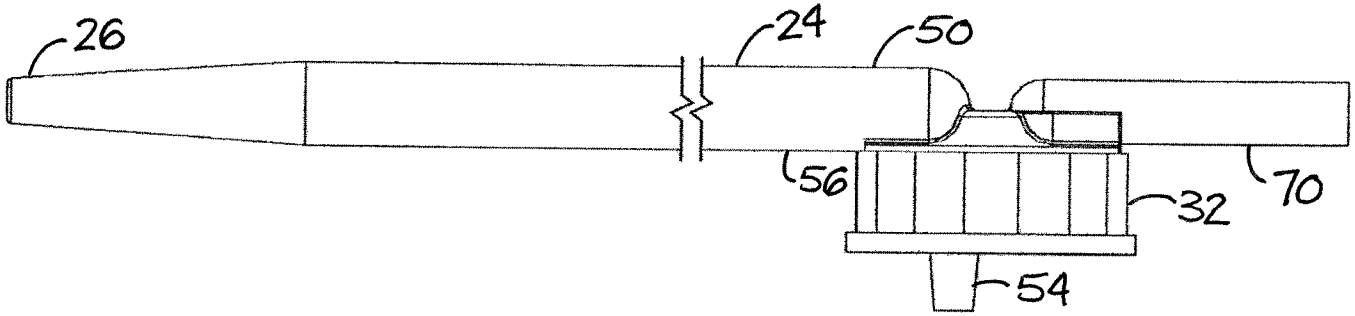
FIG. 5 is a schematic side view of an optional configuration of the adapter having an integrated pipette, according to an illustrative embodiment.
Figure 6:
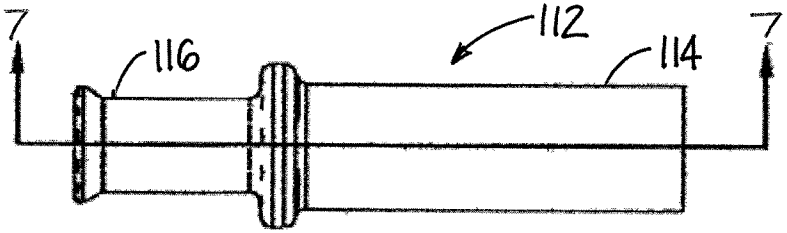
FIG. 6 is a schematic top view of a pipette adapter, according to an illustrative embodiment.
Figure 7:
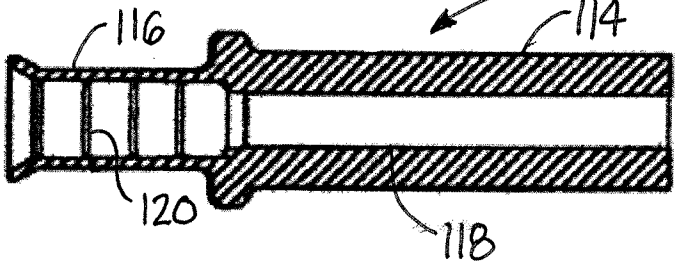
FIG. 7 is a schematic sectional view of the pipette adapter taken along line 7-7 of FIG. 6.
Figure 8:
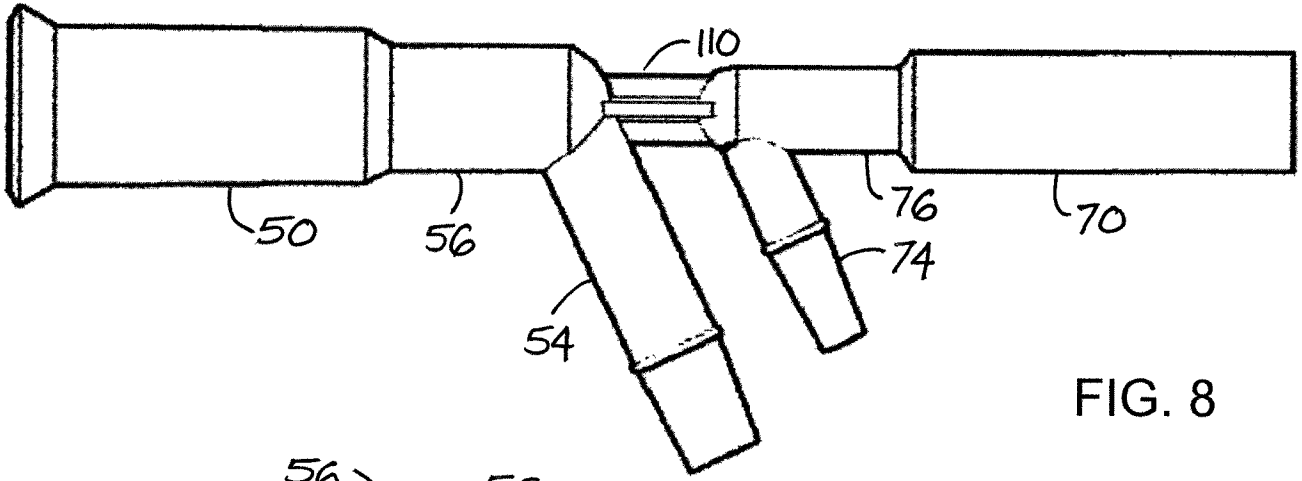
FIG. 8 is a schematic side view of an optional configuration of the adapter in which the cap portion is omitted, according to an illustrative embodiment.
Figure 9:
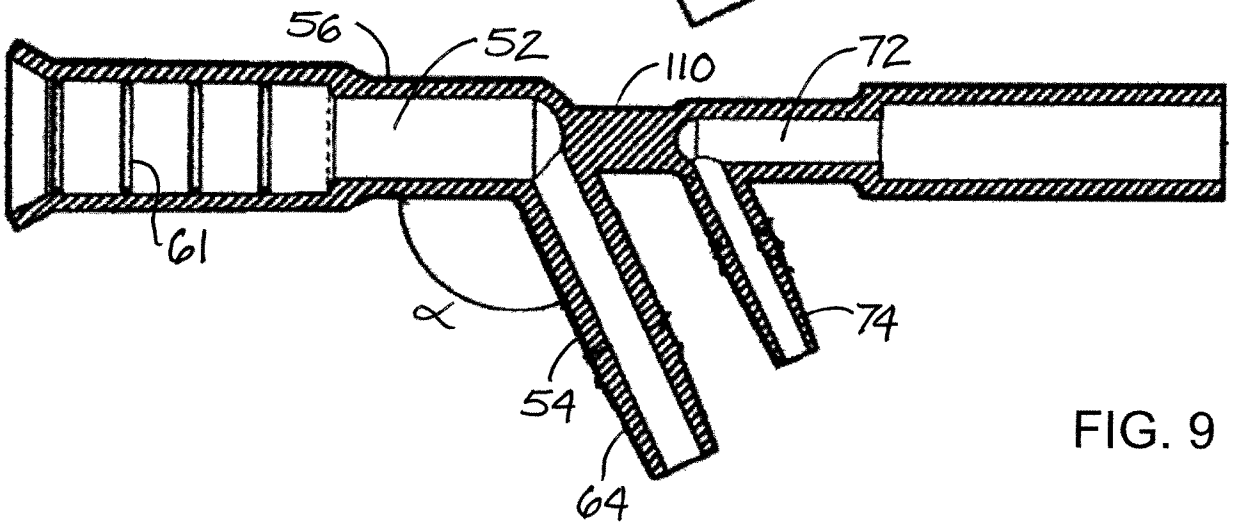
FIG. 9 is a schematic side sectional view of the optional configuration of the adapter shown in FIG. 8, according to an illustrative embodiment.
Figure 10:
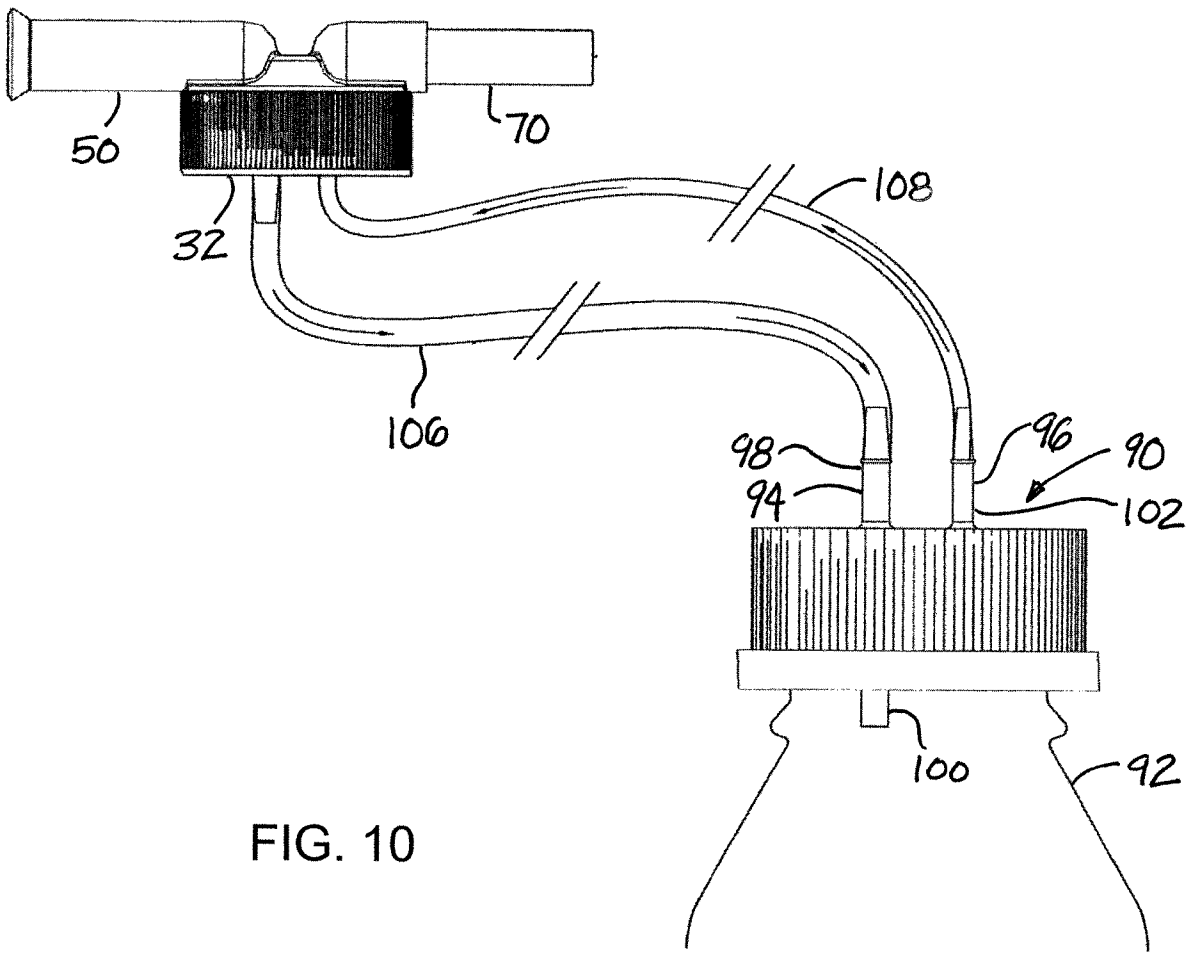
FIG. 10 is a schematic side view of an embodiment of the adapter system utilizing a secondary cap portion.
Figure 11:
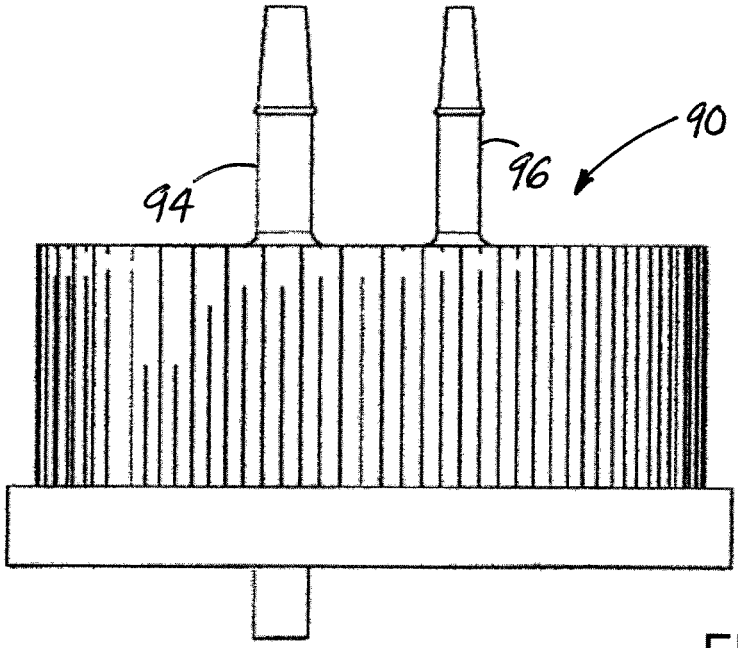
FIG. 11 is a schematic side view of an illustrative embodiment of the secondary cap portion.
Figure 12:
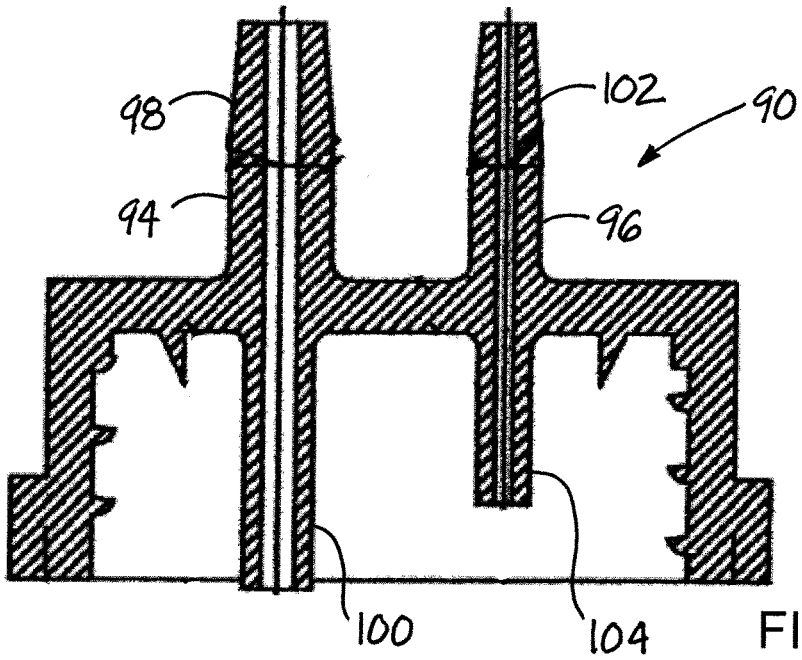
FIG. 12 is a schematic side sectional view of the embodiment of the secondary cap portion shown in FIG. 10.
Figure 13:
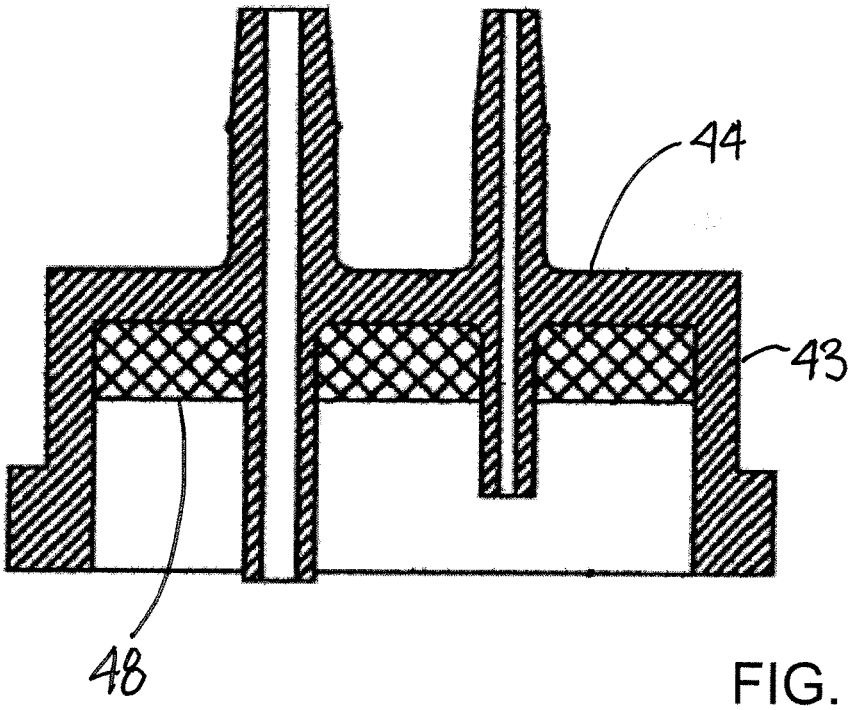
FIG. 13 is a schematic side sectional view of an optional configuration of the secondary cap portion, according to an illustrative embodiment.
Figure 14:
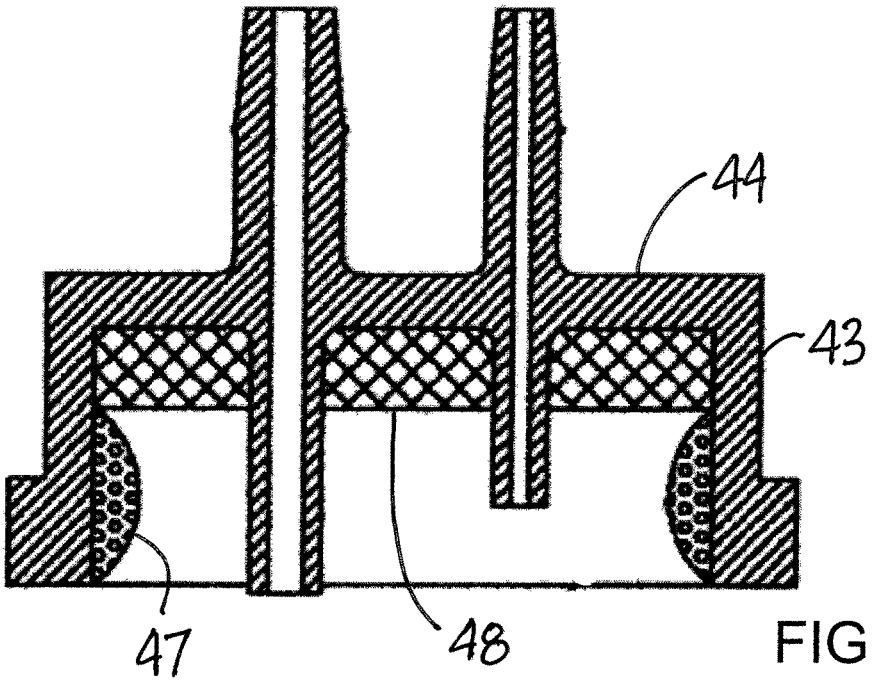
FIG. 14 is a schematic side sectional view of another optional configuration of the secondary cap portion, according to an illustrative embodiment.
Figure 15:
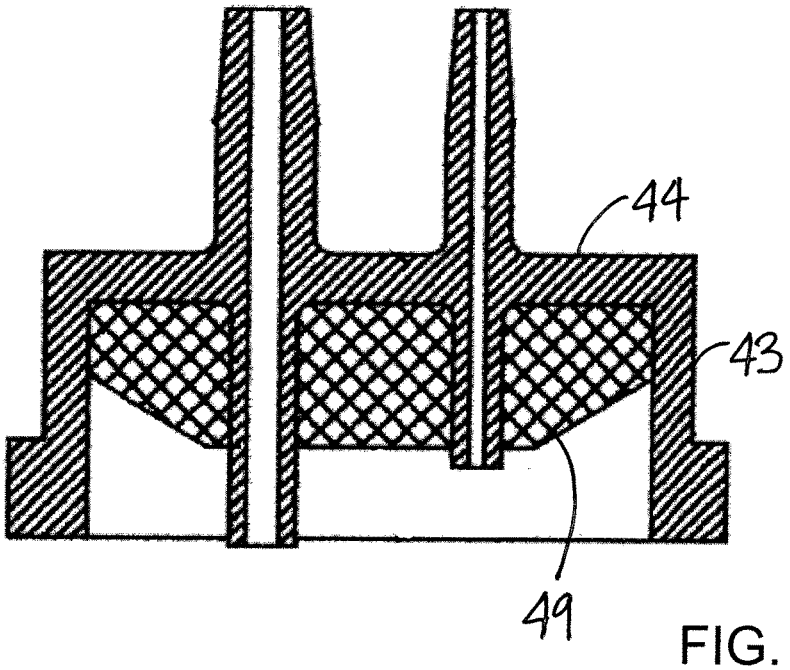
FIG. 15 is a schematic side sectional view of still another optional configuration of the secondary cap portion, according to an illustrative embodiment.
Figure 16:
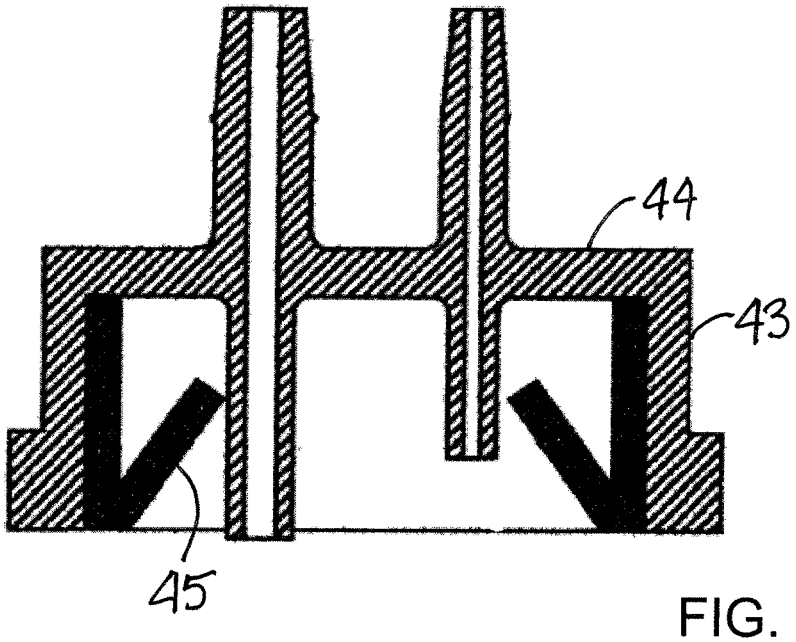
FIG. 16 is a schematic side sectional view of yet another optional configuration of the secondary cap portion, according to an illustrative embodiment.
Figure 17:
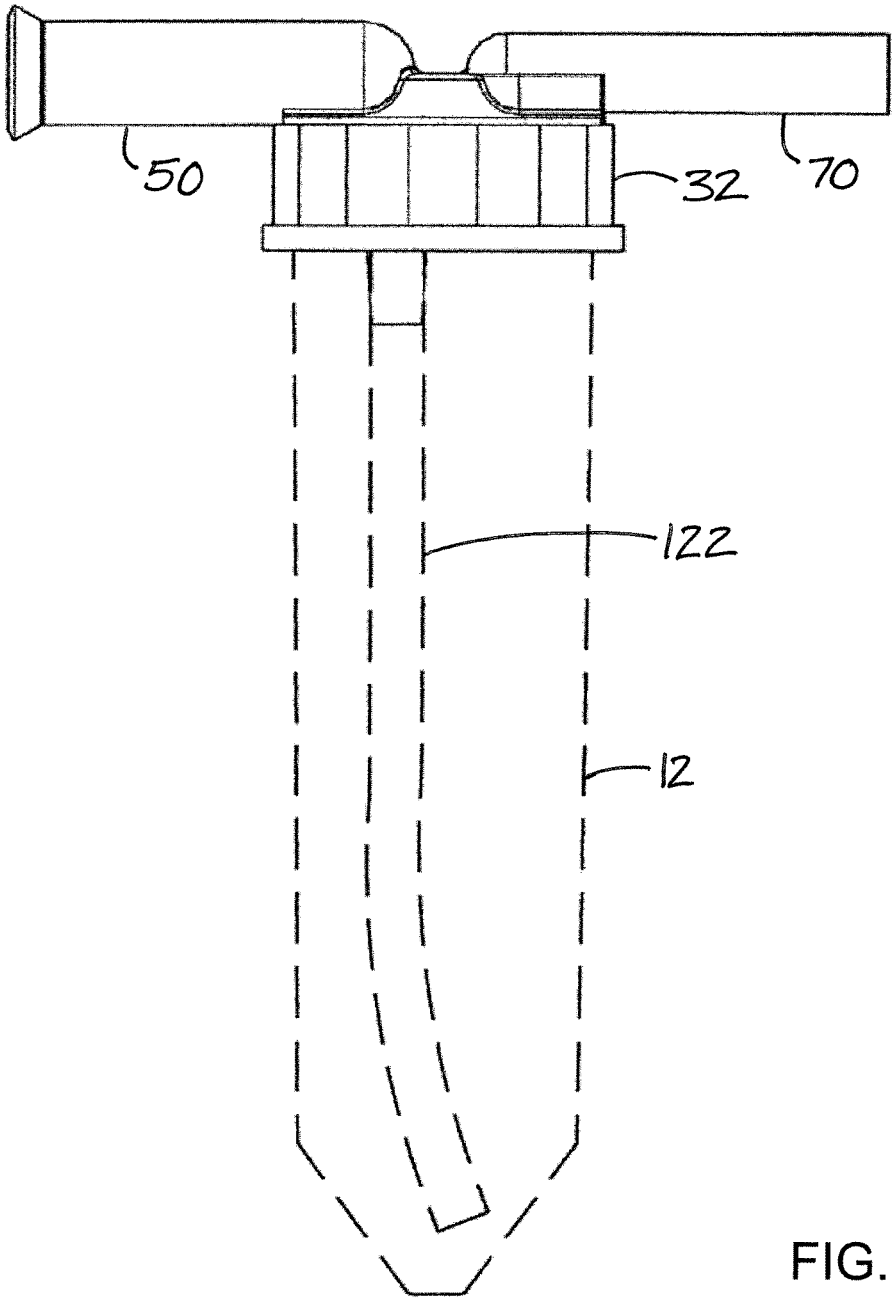
FIG. 17 is a schematic side view of an assembly of the cap portion and collection tube with an uptake tube, according to an illustrative embodiment.
Figure 18:
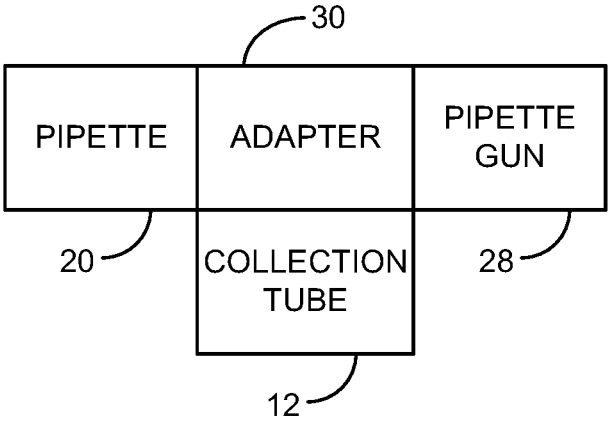
FIG. 18 is a schematic diagram of an embodiment of the system.
Figure 19:
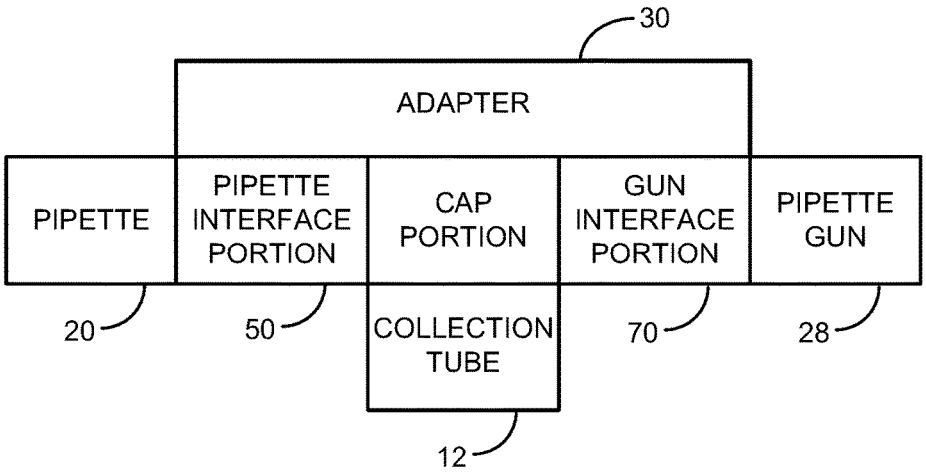
FIG. 19 is a schematic diagram of an embodiment of the system.

The pipette interface portion 50 may be configured to removably mount a pipette 20 to the cap portion 32 for use in the system 10. The pipette interface portion 50 may define a pipette interface passage 52 for extending between an interior of the collection tube 12 to the interior of the pipette 20. The pipette interface portion may be mounted on or integrated with the cap portion 32 and may extend from both the outer side 38 and the inner side 40 of the cap portion 32 such that the pipette interface passage 52 extends through the cap portion to the interior of the collection tube. The pipette interface portion 50 may be configured to support a mounted pipette 20 in a substantially horizontal orientation when the collection tube 12 is mounted on the cap portion and oriented substantially upright. The pipette interface portion 50 may include an inner section 54 with a section of the pipette interface passage 52 and may also include an outer section 56 of the pipette interface portion with a section of the pipette interface passage 52. The inner section 54 may be located on the inner side 40 of the cap portion. The outer section 56 may be located on the outer side 38 of the cap portion and may be configured such that the section of the pipette interface passage of the outer section 56 extends along a first axis 2, and the section of the pipette interface passage of the inner section 54 may extend substantially perpendicular to the first axis 2. The pipette interface portion 50 may have an outer opening 58 for receiving a portion of the pipette 20, and the outer opening may be flared to facilitate insertion of the pipette into the pipette interface passage 52. In some embodiments, the section of the pipette interface passage that is located in the outer section 56 may have an inner surface 60 that is located adjacent to the outer opening 58 and may have at least one annular ridge 61 to engage a portion of a pipette inserted through the outer opening 58. In some embodiments, the inner surface 60 may also have a shoulder 62 to effectively form a stop for a pipette 20 inserted into the outer opening. An outer or exterior surface 64 of the inner section 54 of the pipette interface portion may be tapered in diameter to facilitate mounting of a tube on the inner section, and in some embodiments at least part of the exterior surface of the inner section 54 forms a barbed nipple for the connection of tubing. In some embodiments, such as is shown in FIG. 5, the aspirator adapter 30 may further include a pipette 20 which is integrally formed with the pipette interface portion.

The gun interface portion 70 may be configured to interface with the pipette gun 28, such as through insertion of the portion 70 into the barrel of the pipette gun. The gun interface portion 70 may be mounted on the cap portion 32, and may define a gun interface passage 72. The gun interface portion 70 may extend from the inner and outer sides of the cap portion, and the gun interface passage 72 may extend through the cap portion 32. The gun interface portion 70 may include an inner section 74 located on the inner side which forms a section of the gun interface passage 72 on the inner side of the cap portion and also an outer section 76 of the gun interface portion located on the outer side which forms a section of the gun interface passage 72 on the outer side of the cap portion. In some embodiments, the section of the gun interface passage 72 defined by the outer section 76 may extend along the first axis 2, and the section of the gun interface passage 72 of the inner section 74 may extend substantially perpendicular to the first axis. The gun interface portion 70 may have an outer opening 78 which may be positioned in the pipette gun 28 during use. The section of the gun interface passage 72 which is located in the outer section 76 may have an inner surface 80 which is located adjacent to the outer opening 78, and a fluid stop 82 may be located in the gun interface passage 72 to resist the movement of fluid through the gun interface passage and into the pipette gun 28. An outer or exterior surface 84 of the inner section 74 of the gun interface portion may be tapered in diameter to facilitate the mounting of a tube on the inner section, and at least part of the exterior surface of the inner section 74 may be configured to form a barbed nipple for connection of tubing thereto.

In some implementations of the disclosure, use of a relatively large collection container may be desirable due to the amount of media to be communicated. The relatively large size of the container as compared to the collection tube 12 may make lifting the collection container like the collection tube awkward and thus undesirable. In such applications, a secondary cap portion 90 may be utilized in combination with the cap portion 32 to facilitate movement of media between the container as it rests upon a surface. More specifically, the secondary cap portion 90 may be configured to mount on a collection container 92, and a secondary pipette interface portion 94 as well as a secondary gun interface portion 96 may be mounted on the secondary cap portion 90. An outer section 98 of the secondary pipette interface portion 94 may extend along an axis oriented substantially parallel to an axis of an inner section 100 of the secondary pipette interface portion, and similarly an outer section 102 of the secondary gun interface portion 96 may extend along an axis that is oriented substantially parallel to an axis of the inner section 104 of the secondary gun interface portion. The secondary pipette interface portion 94 and the secondary gun interface portion 96 may both extend through the secondary cap portion. In some embodiments, the outer section of the secondary pipette interface portion and the outer section of the secondary gun interface portion may each form a barbed nipple for the mounting of tubing. The tubing 106 may connect the inner section 54 of the pipette interface portion to the outer section 98 of the secondary pipette interface portion to create fluid communication between the sections as well as between the cap portion 32 and the secondary cap portion 90 as well as a container connected to the secondary cap portion 90. Similarly, the tubing 104 may connect the inner section 74 of the gun interface portion to the outer section 102 of the secondary gun interface portion to create fluid communication between the sections as well as between the cap portion 32 and the container mounted on a secondary cap portion 90.

In some embodiments, the aspirator adapter 30 may lack the cap portion and may include a connector portion 110 (see, e.g., FIGS. 8 and 9) which is configured to connect the pipette interface portion 52 to the gun interface portion 70. The inner sections of the pipette interface portion and the gun interface portion may be connected by tubing to a container, such as by use of the secondary cap portion mounted on the container. The inner section 54 of the pipette interface portion and the inner section 74 of a gun interface portion may be oriented at an offset angle α with respect to the first axis 2. In some implementations, the angle α may measure from approximately 91 degrees to approximately 130 degrees, and in further implementations the angle α may measure from approximately 110 degrees to approximately 120 degrees. In some embodiments, such as illustratively shown in the drawings, the angle α may measure approximately 115 degrees.

Optionally, the system 10 may include a pipette adapter 112 which is configured to be releasably engaged with the pipette interface portion 50, and may be configured to engage pipettes of relatively smaller diameters than are capable of being engaged by the inner surface 60 of the pipette interface portion. The pipette adapter 112 may have a first end 114 with a first end portion of a first diameter configured for inserting into the pipette interface portion 50 of the aspirator adapter 30, and may have a second end 116 with a second end portion of a second diameter configured to receive a pipette 20. The pipette adapter 112 may have a passage 118 extending between the first 114 and second 116 ends for fluid communication therebetween. The passage 118 in the second end portion of the adapter 112 may have a plurality of ribs for engaging and releasably holding the exterior surface of a pipette.

An uptake tube 122 may be connected to the inner section 54 of the pipette interface portion 50 (see e.g., FIG. 16), and may be positioned in the interior of the collection tube or collection container to facilitate the uptake of media contained within the interior into the pipette interface portion as well as a pipette connected thereto.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. An aspirator adapter for distributing media from a collection container through a pipette, the adapter comprising:

a primary cap portion configured to removably mount on the collection container with a recess for receiving a portion of the collection container, the primary cap portion having an inner side oriented toward an interior of the collection container when the primary cap portion is mounted on the collection container and the primary cap portion having an outer side oriented away from the interior of the collection container;

a primary pipette interface portion mounted on the primary cap portion for mounting a pipette on the primary cap portion, the primary pipette interface portion defining a pipette interface passage extending through the primary cap portion, the primary pipette interface portion including an inner section of the primary pipette interface portion being located on the inner side of the primary cap portion, the inner section of the primary pipette interface portion having a section of the primary pipette interface passage, an outer section of the primary pipette interface portion being located on the outer side of the primary cap portion, the outer section of the primary pipette interface portion having a section of the primary pipette interface passage, the primary pipette interface portion having an outer opening for receiving a portion of the pipette; and a primary gun interface portion mounted on the primary cap portion and configured to interface with a pipette gun, the primary gun interface portion defining a gun interface passage extending through the primary cap portion, the primary gun interface portion including an inner section of the primary gun interface portion being located on the inner side of the primary cap portion, the inner section of the gun interface portion having a section of the gun interface passage, an outer section of the primary gun interface portion being located on the outer side of the primary cap portion, the outer section of the gun interface portion having a section of the primary gun interface passage, the primary gun interface portion having an outer opening for insertion into a barrel of the pipette gun;

a secondary cap portion for mounting on the collection container instead of the primary cap portion;

a secondary pipette interface portion mounted on the secondary cap portion and having an outer section located on an outer side of the secondary cap portion;

a secondary gun interface portion mounted on the secondary cap portion and having an outer section located on the outer side of the secondary cap portion;

first tubing connecting the inner section of the primary pipette interface portion to the outer section of the secondary pipette interface portion; and second tubing connecting the inner section of the primary gun interface portion to the outer section of the secondary gun interface portion.

2. The adapter of claim 1 wherein the outer section of the secondary pipette interface portion extends along an axis oriented substantially parallel to an axis of an inner section of the secondary pipette interface portion, and the outer section of the secondary gun interface portion extends along an axis oriented substantially parallel to an axis of an inner section of the secondary gun interface portion.

3. The adapter of claim 2 wherein the outer section of the secondary pipette interface portion includes a barbed nipple and the outer section of the secondary gun interface portion includes a barbed nipple.

4. The adapter of claim 1 wherein an exterior surface of the inner section of the primary pipette interface portion is tapered in diameter to facilitate attachment of the first tubing to the inner section of the primary pipette interface portion, and wherein an exterior surface of the inner section of the primary gun interface portion is tapered in diameter to facilitate attachment of the second tubing to the inner section of the primary gun interface portion.

5. The adapter of claim 1 wherein a surface of the cap portion defining the recess has internal threads formed thereon for engaging external threads on the collection container.

6. The adapter of claim 1 wherein the cap portion includes a lid section and a lip section, the lid section having a perimeter, the lip section extending from an interior surface of the lid section along the perimeter of the lid section to form the recess, the pipette interface passage of the pipette interface portion and the gun interface passage of the gun interface portion forming the only openings in the lid section.

7. The adapter of claim 1 wherein a section of the pipette interface passage of the outer section of the pipette interface portion extends along a first axis, and the section of the pipette interface passage of the inner section of the pipette interface portion extends substantially perpendicular to the first axis.

8. The adapter of claim 1 wherein a flange extends radially outward from the pipette interface portion at the outer opening of the pipette interface portion to facilitate insertion of a pipette into the outer opening of the pipette interface portion.

9. The adapter of claim 8 wherein the section of the gun interface passage of the inner section of the gun interface portion extends substantially perpendicular to the first axis.

10. The adapter of claim 1 wherein an exterior surface of the inner section of the pipette interface portion forms a barbed nipple to facilitate retention of a tube on the inner section of the pipette interface portion.

11. The adapter of claim 10 wherein the exterior surface of the inner section of the gun interface portion forms a barbed nipple to facilitate retention of a tube on the inner section of the gun interface portion.

* * * * *